United States Patent [19]

Matsushima

[11] 4,060,114

[45] Nov. 29, 1977

[54] TIGHTENING DEVICE FOR THREADED SCREW PART

[76] Inventor: Ryuzo Matsushima, 36-7, Oshiage 3-Chome, Sumida, Tokyo, Japan

[21] Appl. No.: 745,289

[22] Filed: Nov. 26, 1976

Related U.S. Application Data

[62] Division of Ser. No. 591,035, June 27, 1975, Pat. No. 4,007, 768.

[30] Foreign Application Priority Data

| | | |
|---|---|---|
| July 3, 1974 | Japan | 49-78859 |
| Nov. 21, 1974 | Japan | 49-141956 |
| May 23, 1975 | Japan | 50-69483 |

[51] Int. Cl.[2] ..... B25B 15/00

[52] U.S. Cl. ..... 145/50 D; 145/50 E

[58] Field of Search ..... 145/50 D, 50 E

[56] References Cited

U.S. PATENT DOCUMENTS

| | | | |
|---|---|---|---|
| 1,951,652 | 3/1934 | Fedotoff | 145/50 D |
| 2,604,912 | 7/1952 | Walker | 145/50 A |
| 2,908,304 | 10/1959 | Sandys | 145/50 E |
| 3,286,749 | 11/1966 | Learned | 145/50 D |
| 3,687,179 | 8/1972 | Totsu | 145/50 E |
| 3,831,648 | 8/1974 | Hill et al. | 145/50 E |

FOREIGN PATENT DOCUMENTS

| | | | |
|---|---|---|---|
| 1,248,671 | 11/1960 | France | 145/50 D |
| 42,598 | 10/1972 | Japan | 145/50 D |
| 1,020,979 | 2/1966 | United Kingdom | 145/50 D |

*Primary Examiner*—James L. Jones, Jr.
*Assistant Examiner*—J. T. Zatarga
*Attorney, Agent, or Firm*—Polster, Polster and Lucchesi

[57] ABSTRACT

A tightening device for threaded screw part having an engaging part to be engaged with the threaded screw part to be tightened and a main body continuous with the engaging part, wherein a groove is formed on at least one surface portion of the engaging part and a small passage is formed within the main body of the tightening device in the axial direction thereof with the rear end thereof being closed, both groove and small passage being aligned in the axial direction of the main body, and an elongated, bow-shaped plate spring having a tapered surface at the front tip end thereof is inserted into the small passage along the groove so that its rear end may be stopped at the innermost part of the small passage and its front end may be substantially in flush with the tip end of the engaging part, whereby, at the time of tightening the threaded screw part, the engaging part firmly grasps the head of the threaded screw part to facilitate the tightening operation.

1 Claim, 17 Drawing Figures

TIGHTENING DEVICE FOR THREADED SCREW PART

This is a division, of application Ser. No. 591,035 filed June 27, 1975, now U.S. Pat. No. 4,007,768.

BACKGROUND OF THE INVENTION

This invention is concerned with improvement in tightening tool for threaded screw part such as screw driver, and so forth. It has heretofore been considered advantageous for increasing working efficiency in continuous tightening operation of threaded screw part, if the tip end of the engagement part of a box spanner or a screw driver, for example, is once fitted onto a head of a bolt, or inserted into a groove of a small screw so as to firmly hold such bolt and screw by the tip end of the engagement part for the subsequent carrying out of the screw tightening work.

There has so far been known a tool of a type, wherein a spring is provided at the tip end of the engagement part of the abovementioned tool with a view to holding a threaded screw part at the tip engagement part by the elastic force of the spring. However, as this known type of the screw tightening tool is rather complicated in its structure for the spring fitting, the manufacturing cost would become high, and, moreover, it has had such a disadvantage that, when the elastic force of the spring has become weakened after repeated tightening operation over a long period of time, exchange of the spring cannot be effected at ease. Also, such tightening tool that is simple in its fitting structure, particularly, such one wherein a plate spring is fixed by a rivet to the main body of the tightening tool per se, cannot be repaired at the users themselves, but must be returned to the manufacturer or dealer at every time the repairing has become necessary. This is highly uneconomical.

SUMMARY OF THE INVENTION

With the abovementioned disadvantage inherent in the conventional type of the tightening tool for threaded screw part in mind, it is an object of the present invention to provide a screw tightening tool which has simplified its fitting structure for the abovementioned spring, and which is suitably excellent for the industrialized mass-production.

It is another object of the present invention to provide a screw tightening tool of a construction which enables a spare spring to be replaced with old one when it has become weak in its spring force through its long period of use.

According to the present invention, the above objectives can be attained by a tightening tool for threaded screw part which comprises in combination a main body of the tightening tool provided with a small passage formed within the main body of the tightening tool in the axial direction thereof and being open at the base portion of the engagement part to face a threaded screw part, an elongated plate spring, the rear end of which is stopped at the innermost part of the abovementioned small passage, and the front end of which is substantially matched at the tip end of the engagement part along the full length of the engagement part, and means to cause the plate spring to protrude outward from the small passage beyond the tip engagement part.

The foregoing objects, other ojects as well as the detailed construction and function of the tightening device for threaded screw part according to the present invention will become more apparent and understandable from the following explanations, when read in connection with the accompanying drawing.

DETAILED DESCRIPTION OF THE PREFERRED EMBODIMENTS

Figure 1:
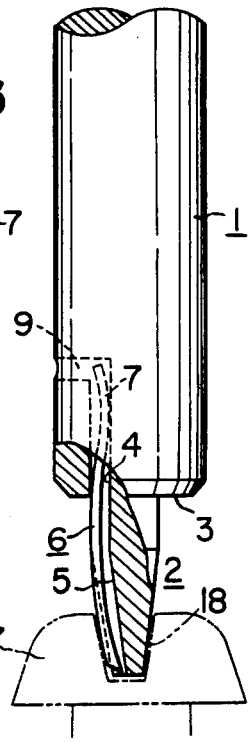
FIG. 1 is a side elevational view of the main part of a screw driver having the tip engagement part in the form of a symbol "minus (−)", with its one part being cut away in the longitudinal direction thereof.
Figure 2:
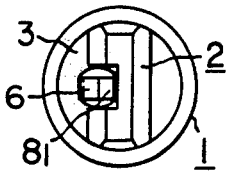
FIG. 2 is a front view of the screw driver shown in FIG. 1.

Referring to FIGS. 1 and 2, there is shown a "minus (−)" screw driver as one example of the tightening device for threaded screw part according to the present invention, which comprises a main body 1 of the screw driver (only the principal portion thereof being illustrated), and an engagement part 2 to be engaged with a tightening groove formed in the head of the threaded screw to be tightened. The main body 1 of the screw driver, at one end thereof where it is continuous with the base portion of the tip engagement part 2, is cut in a flat plane 3 substantially at the vertical angle with respect to the direction of the axial line of the main body 1. This flat plane can be readily formed, for example, by forming the main body 1 in a larger diameter than that of ordinary screw driver, and by shaping the tip engagement part 2 through the cold-forging with simultaneous shaping of the flat plane 3. Upto a certain length within the driver main body, there is formed a groove or a small passage 4 in the direction parallel to the axial line of the main body 1 and at the right angle with respect to the flat plane 3, into which an elongated plate spring to be described later on is accommodated. In forming this passage 4, a groove 5 should first be formed in the axial direction of the main body 1 along one engaging surface portion of the engagement part 2, and then, along and in alignment with this groove 5, a hole for the small passage 4 is drilled into the flat plane 3 of the driver main body.

Figure 3:
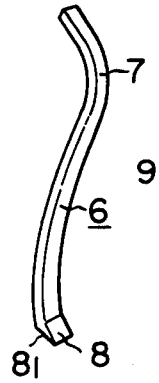
FIG. 3 is a perspective view of an elongated, bow-shaped plate spring for use in the abovementioned screw driver.

An elongated, bow-shaped plate spring 6 having various cross-sectional configuration such as, for example, rectangle, ellipse, and so on, as shown in FIG. 3 is inserted into this small passage 4 along the groove 5 formed on one surface portion of the tip engagement part 2. As shown, this plate spring, at the tip end thereof meeting the tip end of the engagement part 2, is formed in a tapered shape, and, at the rear end thereof is curved to an appreciable degree so as to impart thereto a self-resiliency. Upon insertion of this plate spring into the small passage 4, it snugly and tightly fits therein with its taper-shaped end 8 being in flush with the tip end of the engagement part 2. In this case, the tapered tip end of the spacing 6 is kept slightly separated from the bottom surface of the groove 5 at the tip engagement part 2 by virtue of the curvature of its own as well as the positional relationship thereof with the small passage 4. The tapering surface $8_1$ formed at the outer side of the tapered end 8 of the plate spring 6 serves to provide smooth insertion of the tip engagement part 2 of the screw driver into the groove formed in the head part of the threaded screw to be tightened. Also formed in this main body 1 of the screw driver contiguous to the innermost closed end of the small passage 4 therein is a through-hole 9 drilled transversely from one surface part of the outer periphery of the driver main body 1 in a manner communicative with the closed innermost end of the small passage 4.

In the above-described construction of the tightening device, when the tip engagement part 2 of the device is inserted into the tightening groove 18 of the threaded screw part 17, the tip end 8 of the plate spring 6 facing the tip engagement part 2 of the tightening device is curved toward the direction of the axial line of the main body 1, by the elastic repulsive force of which the outer surface of the plate spring 6 is press-contacted to the inner surface of the groove 18 of the threaded screw 17, thereby firmly securing the screw driver in the head tightening groove of the threaded screw 17. When elasticity of the plate spring 6 has become weak, a thin hand drill, eyeleteer, or the like having a sharpened tip is inserted into this through-hole 9 to push forward the rear end of the plate spring 6 so as to cause it to project outwardly from the small passage beyond the tip engagement part 2 of the screw driver, the rear end resting in the innermost closed end part of the small passage 4, after which its tapered end 8 is clipped by an appropriate tool such as a pincer, etc. to draw it off the small passage 4, followed by replacement of a new plate spring, which can be done simply by its insertion into the small passage 4. Thus, the exchange of old spring with new one is accomplished is quite an easy way.

In view of the foregoing, not only the tightening operation of a threaded screw part can be done efficiently, but also, owing to its extremely simple structure, its manufacturing is easy and suited for industrialized mass-production. Further, the screw driver according to the present invention is effectively applicable as both electrically-operated and manually-operated screw driver. Specifically, in the case of it being used as the electrically-operated screw driver, the base portion of the main body 1, which is not shown in FIG. 1, may be fitted in a holder incorporated therein an electric motor as the prime mover, and, in the case of it being used as the manually-operated screw driver, the base portion thereof may be fitted in a handle.

Figure 4:
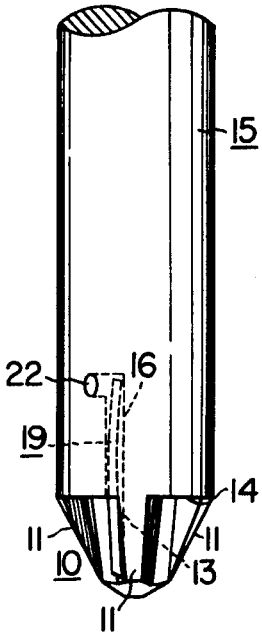
FIG. 4 is a side elevational view of the main part of a screw driver having the tip engagement part in the form of a symbol "plus (+)"
Figure 7:
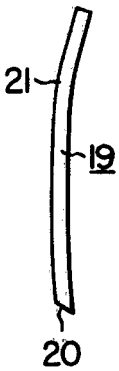
FIG. 7 is a side elevational view of an elongated, bow-shaped plate spring for use in the abovementioned screw driver.
Figure 5:
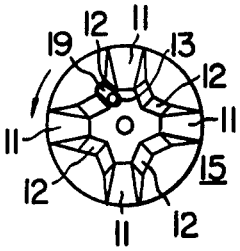
FIG. 5 is a front view of the screw driver shown in FIG. 4.
Figure 6:
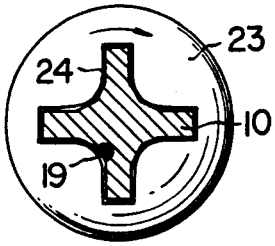
FIG. 6 is a top plan view, with the engagement part of a "plus (+)" screw driver being in cross-section, showing a state of engagement of the screw driver with the threaded screw.
Figure 8:
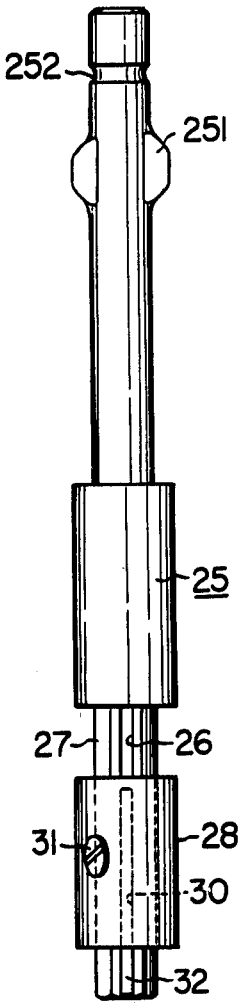
FIG. 8 is a side elevational view of a screw driver for a threaded screw with a hexagonal recess being provided in the head portion thereof.
Figure 10:
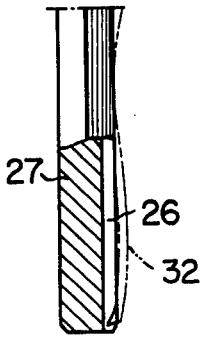
FIG. 10 is a side elevational view of the tip engagement part of the same screw driver with its one part being cut away in the longitudinal direction thereof.

Referring now to FIGS. 4 to 6 which illustrate the second embodiment of the present invention, the screw driver has the tip engagement part in the form of a cross, or a symbol "plus (+)". In this case, a guide groove 13 is formed along the axial direction of the driver main body 15 at one of the inclined surfaces 12 in the following direction, i.e., the rotational direction, of the cross-shaped blade 11 at the tip engagement part 10. Then, in communicating with this guide groove 13, a small passage 16 is drilled in the direction parallel to the axial line of the main body 15 at a flat plane formed in contiguity to the end part of the main body substantially at the vertical angle with respect to the axis of the main body 15. In this small passage 16 thus drilled, an elongated, bow-shaped spring 19 having a circular cross-section, as represented by the piano-wire, etc., as shown in FIG. 7 is inserted and held at the innermost part thereof. It is, of course, possible that the elongated, bow-shaped spring having a rectangular or like other flat cross-section be used. The spring 19 is provided at one end thereof with a tapered surface 20, and at its other end with a slightly bent portion 21. Also, a small port 22 for pushing out the worn out spring from the small passage 16 is drilled from one surface part of the outer periphery of the driver main body in a manner communicative with the innermost closed end of the small passage 16 within the driver main body 15.

In the above-described arrangement of the spring 19, when the tip engagement part 10 is inserted into a cross-shaped groove 24 formed in the head part of a threaded screw 23 to be tightened, while rotating the driver main body 15 applied as an electrically-operated screw driver, the smooth insertion thereinto is secured without the tip end of the spring being hooked at the edge of the cross-shaped groove 24.

Further, depending on the necessity, it is possible to provide the springs at both side surfaces of the "minus (−)" screw driver, and a plurality of the inclined surfaces 12 of the "plus (+)" screw driver so as to increase grasping force on the small threaded screw.

In the above-described two practical embodiments, a small passage 4, 16 is formed in the plane 3, 14 of the driver main body at an angle substantially vertical to the axial line of the main body, into the small passage of which the spring 6, 19 is inserted and held therein. On the other hand, it is also possible that, instead of forming the vertical plane with respect to the axial direction of the driver main body, a groove is straight-forwardly formed in the axial direction of the main body from its tip end, and the spring is inserted into this groove, thereafter a sleeve is slidably fitted thereon and fixed to hold the spring.

Figure 12:
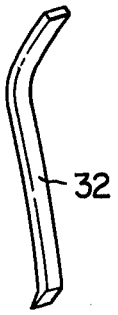
FIG. 12 is a perspective view of an elongated, bow-shaped plate spring for use in the abovementioned screw driver.
Figure 11:
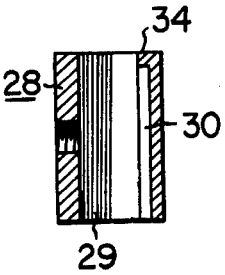
FIG. 11 is a longitudinal cross-sectional veiw of a sleeve attachment to the screw driver shown in FIG. 8.
Figure 9:
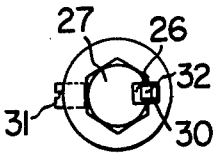
FIG. 9 is a front view of the screw driver shown in FIG. 8.
Figure 13:
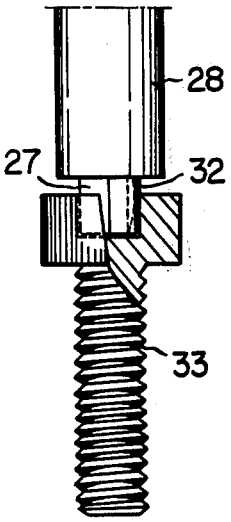
FIG. 13 is a side elevational view, with one part cut away, showing a state of engagement between the abovementioned screw driver and the threaded screw having the hexagonal recess in the head part thereof.

FIGS. 8 through 13 illustrate still another embodiment of the present invention, in which the device is applied to a threaded screw part having a hexagonal engagement part. As seen in these drawings, the driver main body 25 is of a hexagonal shape in its cross-section, and has the engagement part 27 successively formed therewith with a groove 26 being provided in one side surface in the direction of the axial line thereof. A sleeve 28 has a hexagonal through-hole 29, along the inner surface of one of the hexagonal peripheral walls of which there is formed a groove 30 in the longitudinal direction thereof with its rear or top end being closed 34. When the sleeve 28 is slip-fitted on the tip engagement part 27 with the respective grooves 30 and 26 being accurately faced each other, and the tip engagement part 27 is projected outwardly in a predetermined amount from the front or bottom end of the sleeve 28, a small passage is formed at the base part of the tip engagement part to be engaged with the head of a threaded screw 33 by the mutually facing grooves 26 and 30. Then, the sleeve 28 and the tip engagement part 27 thus mated at their grooves are tightly fixed by a small threaded screw 31 for stopping them against unexpected slippage movement. Into this small passage thus formed, there is inserted and fixed an elongated, bow-shaped plate spring 32 as shown in FIG. 12 in the same manner as in the previous embodiments. Incidentally, the base part of the driver main body 25 is provided with a plurality of projections 251 to be engaged with a holder incorporated therein an electric motor, and a groove 252 just above the projections 251 to serve for the same purpose.

In the above-described construction, when the tip end of the spring is worn out or broken, the sleeve 28 is simply slid downward to push out the spring 32 by the closed rear end 34 of the groove 30, wherby replacement can be done very easily between the useless spring and the new one. Also, when the rate of wear is slight, the plate spring can still serve for further use by pushing the spring out of the sleeve to a required extent as in the use of a mechanical pencil.

In place of using the above-described sleeve, the small passage may be directly formed in the driver main body 25 in the same way as in the embodiments shown in FIGS. 1 and 7, and the spring is inserted in the same manner. It should be understood that the shape of the tip engagement part of the abovementioned tightening device may not only be hexagonal, but also be of any other desired shape such as square, etc., all being equally applicable for the purpose of the present invention.

Figure 14:
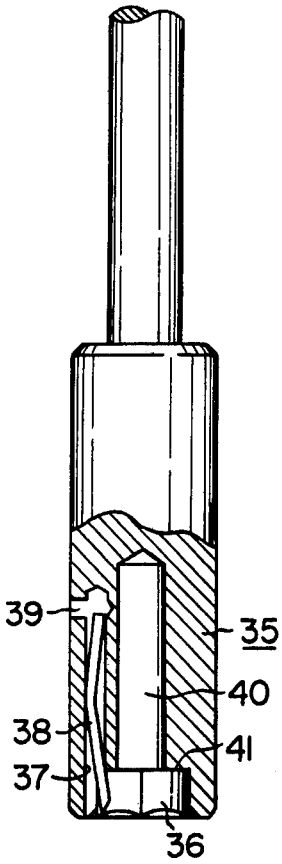
FIG. 14 is a side elevational view, with one part thereof being cut away in the longitudinal direction thereof, showing a construction of a box spanner according to the present invention.
Figure 16:
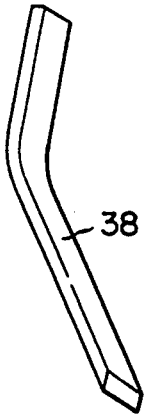
FIG. 16 is a perspective view of an elongated, bow-shaped plate spring for use in the abovementioned box spanner.
Figure 17:
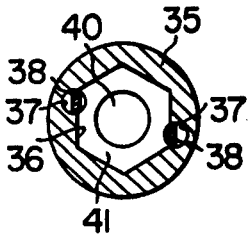
FIG. 17 is a cross-sectional view of a modification of the box spanner according to the present invention.
Figure 15:
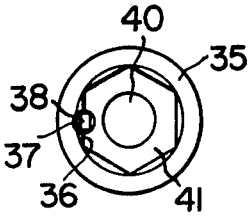
FIG. 15 is a front view of the box spanner shown in FIG. 14.

Referring now to FIGS. 14 to 17 which show still other embodiment of the present invention, there is formed a small passage 37 in the axial direction of the main body of a box (or socket) spanner 35, which opens at the engagement part formed at the tip end of the main body, or, more specifically, at the corner of the bottom surface 41 of the hexagonal recess 36 to be fitted on the outer periphery of the nut (or a head of a bolt). Into this small passage 37, an elongated, bow-shaped plate spring 38 as shown in FIG. 16 is inserted with its tip end being slighly projected into the hexagonal socket 36. At the innermost closed end of the small passage 37, there is formed a transverse hole 39 for pushing out a worn-out, used spring 38. A reference numeral 40 in FIG. 14 is a passage hole for accommodating the tip end of the bolt at the time of the nut tightening. In some occasion, the abovementioned bow-shaped plate spring 38 may be provided at opposite corners in the hexagonal socket as shown in FIG. 17. As described in the foregoing, when the tip end of the bow-shaped, plate spring 38 is caused to project into the hexagonal socket 36, even a thin nut can be easily grasped without failure.

In the foregoing, the present invention has been described with reference to preferred embodiments thereof. It should, however, be noted that these embodiments are merely illustrative and not restrictive, and that changes and modifications may be made by those skilled in the art without departing from the spirit and scope of the present invention as recited in the appended claims.

What is claimed is:

1. A screw driver which comprises in combination:

a shank with one end portion thereof fitted to a holder of a handle, and with an opposite end portion thereof provided with a flat plane or surface in the direction substantially perpendicular to the axis of said shank;

an engaging means having engaging blades in the shape of the cross, or a "Plus (+)", to be engaged with a threaded screw, and projecting from said flat plane of said shank;

a narrow groove formed in the inclined surface of one of the cross-shaped blades of said engaging means at the intersection thereof along the axial direction of said shank and to the side of the forwarding or rotational direction of said screw driver;

a small passage formed in said shank, one end thereof being blind within said shank, and the other end thereof being open at said flat end surface of said shank;

a wire spring having a bent portion at the rear part thereof and a tapering surface at the tip end thereof, said spring extending from the blind portion of said small passage up to the open end of said narrow groove, the rear part of said spring being held in the blind portion of said small passage due to self-resiliency of said bent portion thereof, and the tip end of said spring projecting from said narrow groove with its tapering surface to the cross-shaped groove formed in the head part of the threaded screw; and a small port formed in said shank in the direction substantially perpendicular to the axis of the shank, one end thereof meeting the blinded position of said small passage, and the other end thereof being open at the peripheral surface of said shank, said small port serving to push forward the rear end of said spring at the time of exchanging said spring.

* * * * *

UNITED STATES PATENT AND TRADEMARK OFFICE

CERTIFICATE OF CORRECTION

PATENT NO. : 4,060,114

DATED : November 29, 1977

INVENTOR(S) : Ryuzo Matsushima

It is certified that error appears in the above-identified patent and that said Letters Patent are hereby corrected as shown below:

[73] Assignee: Yuugen Kaisha Matsushima Seisakusho, Tokyo, Japan

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*